US006174125B1

(12) United States Patent
Davis et al.

(10) Patent No.: US 6,174,125 B1
(45) Date of Patent: Jan. 16, 2001

(54) METHOD AND APPARATUS FOR RACKING AND UNRACKING PIPE

(75) Inventors: Marney L. Davis, Hampton; George H. Wallace, Seaford, both of VA (US); Loren C. Cave; Donald R. Stevenson, both of Longview, TX (US)

(73) Assignee: Newport News Shipbuilding & Dry Dock Company, Newport News, VA (US)

( * ) Notice: Under 35 U.S.C. 154(b), the term of this patent shall be extended for 0 days.

(21) Appl. No.: 09/408,434

(22) Filed: Sep. 29, 1999

(51) Int. Cl.[7] ..... B66F 09/18

(52) U.S. Cl. ..... 414/746.5; 294/93; 414/618; 414/910

(58) Field of Search ..... 294/93, 98.1; 414/618, 414/746.5, 910

(56) References Cited

U.S. PATENT DOCUMENTS

| | | | | |
|---|---|---|---|---|
| 3,134,620 | * | 5/1964 | Blaisdell | 294/93 X |
| 4,050,731 | | 9/1977 | Coone et al. . | |
| 4,173,368 | * | 11/1979 | Haverbusch | 294/93 X |
| 4,410,210 | | 10/1983 | de Sivry et al. . | |
| 4,687,244 | | 8/1987 | Cullen et al. . | |
| 4,777,792 | | 10/1988 | Marzoli . | |
| 5,090,758 | * | 2/1992 | Lord | 294/98.1 |
| 5,186,477 | | 2/1993 | Nakazawa et al. . | |
| 5,221,099 | | 6/1993 | Jänsch . | |
| 5,322,300 | | 6/1994 | Mistrater et al. . | |
| 5,468,116 | | 11/1995 | Reichert et al. . | |

* cited by examiner

*Primary Examiner*—Janice L. Krizek
(74) *Attorney, Agent, or Firm*—Joy L. Bryant; Bart A. Singer

(57) ABSTRACT

The present invention is directed towards a method for racking or unracking pipe to or from a rack and a device to facilitate the process. The method provides a controllable procedure for inserting or withdrawing the pipe that is less dangerous than prior art methods and does not damage the pipe end. The method entails inserting a pipe gripper having an expansion sleeve into an accessible end of a pipe. The expansion sleeve is forced against an inner wall of the pipe, coupling the pipe gripper to the pipe. Depending upon the application, the pipe is then either pushed fully onto the rack or is pulled partially off the rack. For unracking operations, a crane sling is attached to the partially unracked pipe and the pipe is further manipulated off the rack.

5 Claims, 6 Drawing Sheets

METHOD AND APPARATUS FOR RACKING AND UNRACKING PIPE

FIELD OF THE INVENTION

The present invention relates to racking and unracking a pipe. In particular, it relates to a method and apparatus for racking and unracking pipe wherein the apparatus has an expansion sleeve.

BACKGROUND OF THE INVENTION

As shown in FIG. 1, pipes 100 are often warehoused in tiered racks 110. Three tiers are shown in FIG. 1, but pipe racks having five or more tiers are common in practice. Typically, the warehouse will have an overhead crane for moving the pipes. However, wrapping a crane sling around a pipe 100 disposed in a rack 110 is difficult, especially if the pipe 100 is not located on the top tier. Therefore, it is necessary to partially withdraw the pipe 100 from the rack 110 before the crane sling is wrapped around it. Prior methods of accomplishing this task were dangerous and often resulted in damage to an end of the pipe 100.

The present invention eliminates these drawbacks by providing a controllable means for withdrawing the pipe and reducing the possibility of damage to the pipe. The present invention also provides a useful means for inserting a pipe into a rack with minimal risk of damaging the pipe. A number of prior inventions disclose mechanisms for gripping and manipulating tubular structures, but none will perform satisfactorily when used to rack or unrack pipe.

Cullen et al. (U.S. Pat. No. 4,687,244) describe a lifting and reorienting mechanism. The device includes a probe for insertion into an axially extending opening of a structure to be moved. When fully inserted, movement of an outer sleeve deploys tooth-like retractable projections that extend radially from the probe. The retractable projections are forced against the inner wall of the structure to be moved. An important feature of the Cullen et al. device is a dual-arm telescoping actuator that facilitates pivoting of the probe and the structure to be moved. Although this device is capable of performing many useful functions, it is not well suited for the racking and unracking of pipes. The pivoting capability of the device is not required for pipe racking and unracking and might pose a safety hazard should it be accidentally activated. In addition, the retractable projections of the device are likely to damage the inner surface of the pipe.

Marzoli (U.S. Pat. No. 4,777,792) discloses a tube gripping device that is designed to be used in textile machines to automatically replace with empty tubes those tubes that have been wrapped with yarn. The gripping device comprises a substantially cylindrical central steel element that has its lower end of frusto-conical shape and is free to slide axially in a cylindrical gripping element. The cylindrical gripping element has its bottom shaped to receive the lower end of the cylindrical steel element. An axial upward movement of the cylindrical central element forces a localized region of the cylindrical gripping element radially outward, thereby pressing that region of the cylindrical gripping element against the inner wall of the tube. The radially outward movement of the cylindrical gripping element is localized in the vicinity of the frusto-conical lower end of the cylindrical central element. In addition, the radial motion is a direct response to the radial component of the force exerted on the cylindrical gripping element by the frusto-conical lower end of the cylindrical central element. The localized nature of the gripping force is not desirable for the pipe racking and unracking application being considered herein.

Mistrater et al. (U.S. Pat. No. 5,322,300) describe several variants of a device for supporting hollow cylinders while they are coated with an electrophotographic-imaging layer. The devices comprise an elongated arm with a shaft extending therethrough. The shaft includes a presser means at one end. An expandable disk shaped member is coaxially aligned with and slidably mounted on the shaft between the presser means and an end of the elongated arm. In an undeformed state, the expandable disk shaped member fits in a hollow cylinder with a preferred clearance of about 250 micrometers (0.01 in). Expansion of the disk shaped member is achieved by compressing the member between the presser means and the end of the elongated arm. Additional features of the Mistrater et al. device ensure that a constant force is applied to the hollow cylinder in spite of temperature variations. However, the Mistrater et al. device fails to provide a means for self-orienting the device coaxially with the hollow cylinder.

SUMMARY OF THE INVENTION

The present invention includes a method for racking and unracking pipe and a device to facilitate the process. For the case in which a pipe needs to be removed from a rack (unracking), the method involves providing a pipe gripper having an expansion sleeve and inserting the pipe gripper into an accessible end of a pipe. After insertion, the pipe gripper is activated, thereby forcing the expansion sleeve against an inner wall of the pipe. With the expansion sleeve pressed against the pipe inner wall, the pipe gripper moves so as to slide a portion of the pipe off the pipe rack. With one end of the pipe supported by the pipe gripper and the other end still supported by the pipe rack, a crane sling is attached to the pipe and the pipe is further manipulated off the rack. The use of a forklift coupled to the pipe gripper further facilitates the process. The new method eliminates the dangerous conditions of prior unracking methods and also avoids the need to repair pipe ends.

The case in which a pipe is to be inserted onto a rack (racking) is similar to the unracking process. In the racking process, a pipe that is supported in a crane sling is manipulated so as to place a first end of the pipe on the rack. A pipe gripper having an expansion sleeve is inserted into an accessible end of the pipe and the crane-sling support is removed. The pipe gripper is activated, thereby forcing the expansion sleeve against an inner wall of the pipe and the pipe gripper then moves so as to slide the pipe fully onto the pipe rack. To facilitate the processes, a sophisticated pipe gripper is used. The pipe gripper comprises an expansion sleeve having a distal end a proximal end, and a bore therethrough. A proximal pressure plate abuts the proximal end of the expansion sleeve. A nosepiece is located at the distal end of the expansion sleeve. The nosepiece assists in orienting the pipe gripper coaxially with a pipe to be gripped. A mandrel passes through the bore of the expansion sleeve and is attached to the nosepiece. Tension in the mandrel axially squeezes the expansion sleeve between the nosepiece and the proximal pressure plate. The squeezing forces a radial expansion of the expansion sleeve against an inner wall of the pipe. When pressed against the inner wall of the pipe, the expansion sleeve frictionally couples the pipe to the pipe gripper, thereby allowing the pipe to be moved along its axis.

Additional objects and advantages of the invention will be set forth in part in the description which follows, and in part will be obvious from the description, or may be learned by practice of the invention. The objects and advantages of the invention will be obtained by means of instrumentalities in combinations particularly pointed out in the appended claims.

BRIEF DESCRIPTION OF THE DRAWINGS

The accompanying drawings illustrate a complete embodiment of the invention according to the best modes so far devised for the practical application of the principles thereof, and in which.

DETAILED DESCRIPTION OF THE PREFERRED EMBODIMENTS

Figure 1:
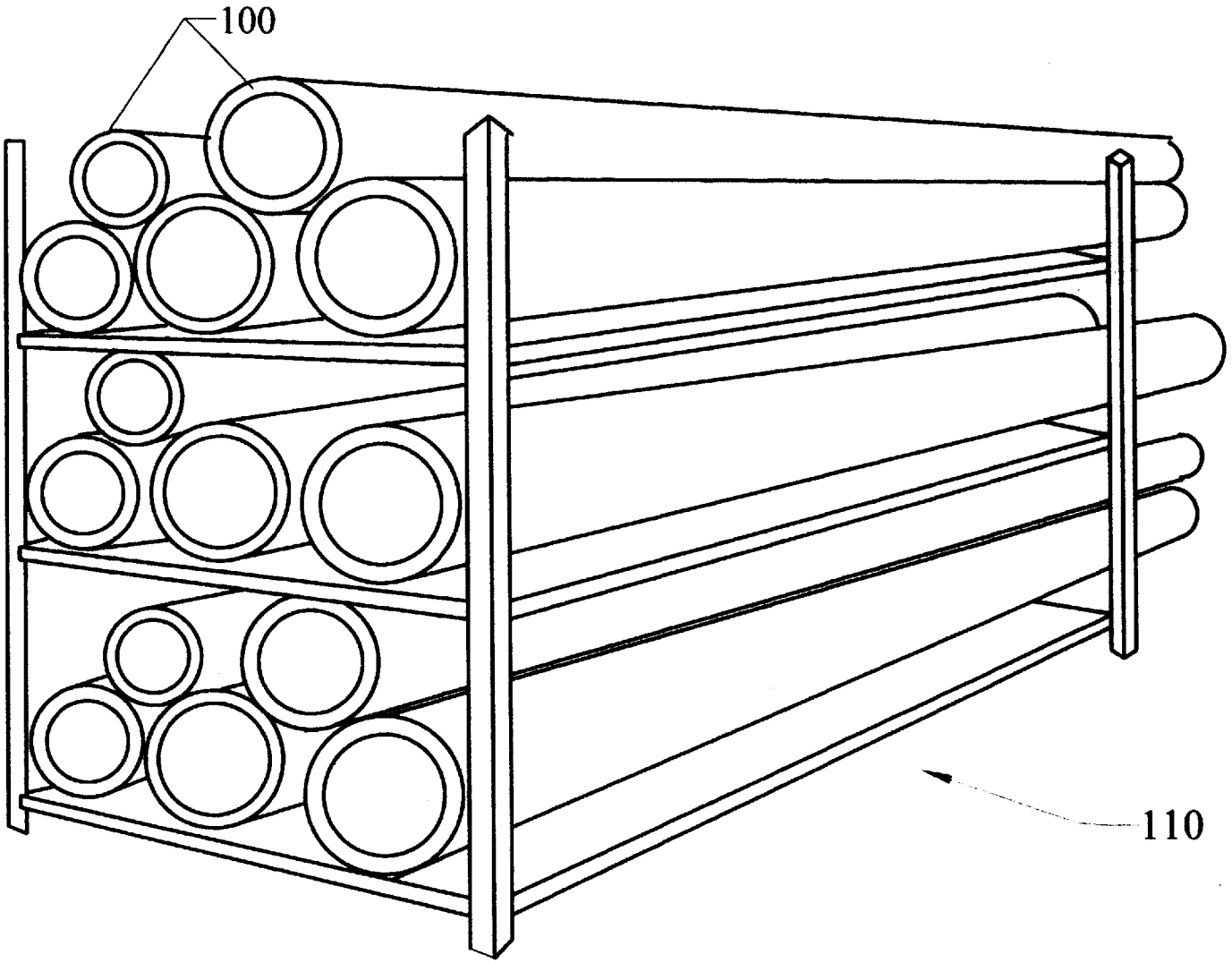
FIG. 1 shows pipes in a three-tiered pipe rack.
Figure 2:
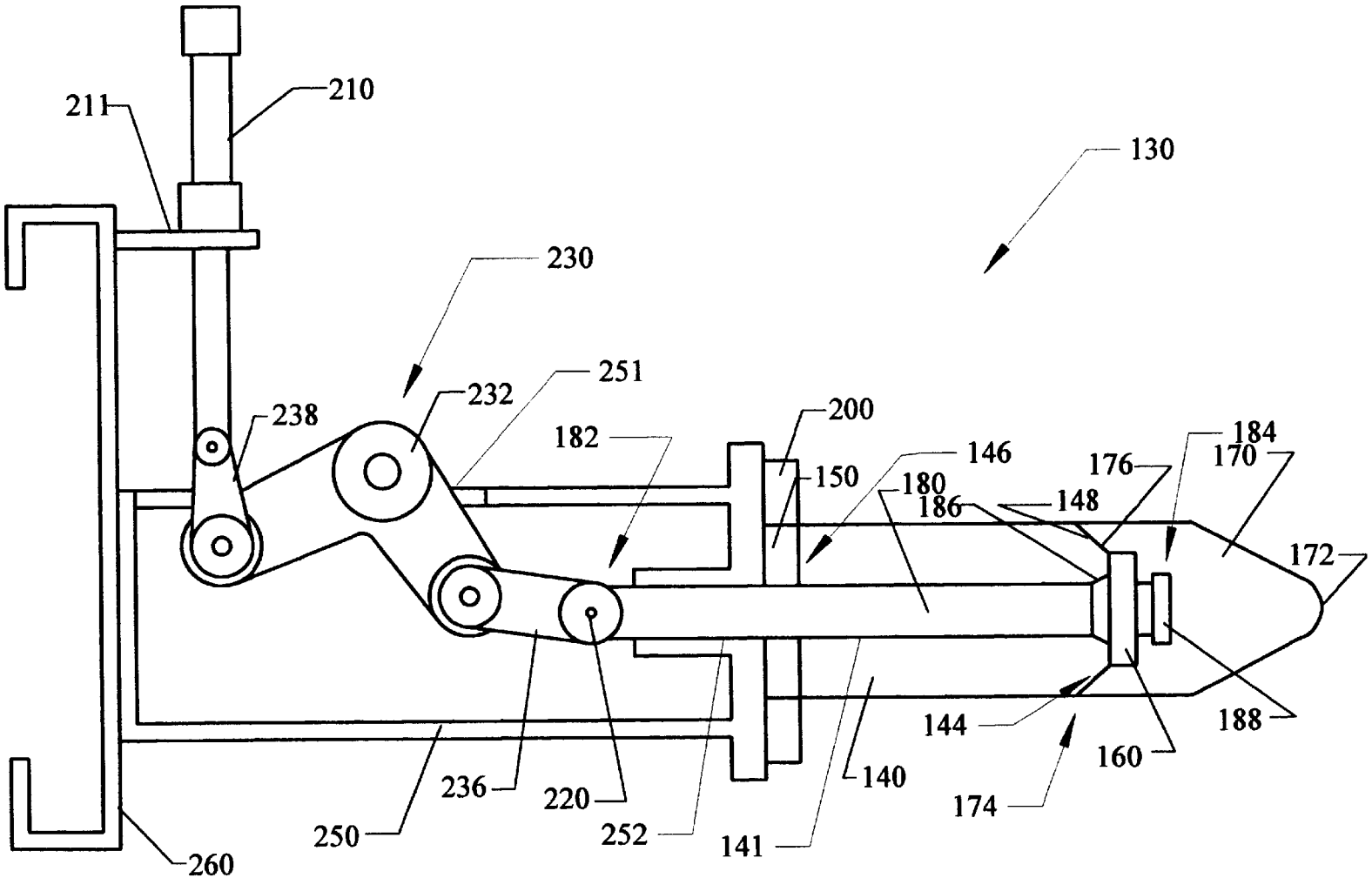
FIG. 2 shows a preferred embodiment of a pipe gripper in its deactivated mode.

Referring now to the drawings, where similar elements are numbered the same, FIG. 2 illustrates a pipe gripper 130 in its deactivated mode. The pipe gripper 130 comprises an expansion sleeve 140 having a bore 141 therethrough. The expansion sleeve 140 is preferably made from an elastomeric substance, which most preferably has a durometer value ranging from about 70 to about 80. All durometer values reported herein use Shore A. The proximal end 146 of the expansion sleeve 140 abuts against a proximal pressure plate 150. The distal end 144 of the expansion sleeve 140 is preferably shaped to have an external bevel 148. A mandrel 180, having a proximal end 182 and a distal end 184 passes through the bore 141 in the expansion sleeve 140. The distal end 184 of the mandrel 180 extends beyond the distal end 144 of the expansion sleeve 140 and is attached to a nosepiece 170. In preferred embodiments, the distal end 184 of the mandrel terminates in an endcap 188 embedded in the nosepiece 170. In some embodiments the endcap 188 is integral with the mandrel 180, although in other embodiments the endcap 188 is a separate piece that is secured to the mandrel 180. Because the radius of the endcap 188 is greater than that of the adjacent portion of the mandrel 180, the nosepiece 170 is securely attached to the mandrel 180 in this preferred embodiment.

The preferred nosepiece 170 has an external shape that is generally cylindrical near its base 174 changing to generally conical near its tip 172. Preferably, the tip 172 is rounded and the base 174 has an internal bevel 176. The internal bevel 176 of the base 174 is angled to mate with the external bevel 148 of the distal end 144 of the expansion sleeve 140. As will be discussed in more detail later, the mating beveled portions of the nosepiece 170 and the expansion sleeve 140 control the bulging of the expansion sleeve 140 when it is axially compressed. Preferably the nosepiece 170 is made from an elastomeric substance with a durometer value of approximately 90.

In the most preferred embodiments of the pipe gripper 130, a distal pressure plate 160 is secured to the mandrel 180 in the region where the nosepiece 170 and the expansion sleeve 140 meet. As shown in FIG. 2, the mandrel 180 preferably includes a flare 186 adjacent to the distal pressure plate 160. As with the endcap 188, the flare 186 and the distal pressure plate 160 can be either integral with the mandrel 180 or separate pieces that are secured to the mandrel 180.

In operation, the nosepiece 170 and the expansion sleeve 140 of the pipe gripper 130 are inserted into a pipe. Preferred embodiments include a limiter that limits the axial motion of the pipe gripper 130. The term "limiter" is intended to include devices such as sophisticated electronic sensors coupled in a feedback loop with the source of axial motion. In the most preferred embodiments (shown in FIGS. 2, 4, 5, and 6) the limiter 200 is a bumper pad coupled to the proximal pressure plate 150. Contact of the bumper pad 200 with an end of a pipe prevents further insertion of the pipe gripper 130 into the pipe. In the most preferred embodiments, the bumper pad 200 is a radial extension of the proximal pressure plate 150, both pieces being fabricated as a single integral piece of material. The proximal pressure plate 150 is an annular portion of the material contacting the expansion sleeve 140 while the bumper pad 200 extends outside of the region of contact with the expansion sleeve 140. Most preferably the material is made of an elastomer with a durometer value ranging from about 85 to about 95. In other embodiments the bumper pad 200 is not disposed in the same plane as the proximal pressure plate 150. Such an arrangement would be preferable if deeper insertion of the expansion sleeve 140 into the pipe were desired. Although the coupling between the bumper pad 200 and the expansion sleeve 140 is indirect, their spatial relationship determines how deeply the expansion sleeve 140 can be inserted into the pipe.

With reference again to FIG. 2, in the preferred embodiments, the pipe gripper 130 includes an actuator 210, a transmission 230, and a retaining device shown here as a quick-change retainer pin 220. The quick-change retainer pin 220 couples the proximal end 182 of the mandrel 180 to the transmission 230. The transmission 230 transforms and transmits the motion of the actuator 210 into axial motion of the mandrel 180.

Preferably, the retaining device allows the assembly that includes the mandrel 180, the expansion sleeve 140, and the nosepiece 170 (as well as any parts secured thereto) to easily disconnect from the transmission 230 and be replaced with a new assembly that is sized for a different diameter pipe. The use of a quick-change retainer pin 220 as the retaining device facilitates rapid removal and attachment of the assembly. Whether or not the proximal pressure plate 150 and the bumper pad 200 are also exchanged when a newly sized assembly is put in place depends on the arrangement itself. Exchange of the material used for the proximal pressure plate 150 and the bumper pad 200 is dependent in part upon the size of the material and whether the proximal pressure plate 150 is secured to the expansion sleeve 140 or simply abuts against it.

In the most preferred embodiments the transmission 230 comprises a vertical link 238 connected to the actuator 210, a horizontal link 236 coupled to the mandrel 180 through the use of the quick-change retainer pin 220, and a bell crank 232. One lever arm of the bell crank 232 is coupled to the vertical link 238 and the other lever arm of the bell crank 232 is coupled to the horizontal link 236. In this arrangement, vertical motion from the actuator 210 is transformed to horizontal motion and transmitted to the mandrel 180.

The most preferred embodiments include a housing 250, which is coupled to the proximal pressure plate 150. Most preferably, the proximal pressure plate 150 and the bumper pad 200 simply abut against a portion of a housing 250. In addition, the housing 250 most preferably provides an opening 252 for the mandrel 180 to pass therethrough and an opening 251 for the transmission 230. Support for the axis of the bell crank 232 is not shown, but the design of such a support is straightforward to those skilled in the art.

A forklift bracket 260 is also included in the most preferred embodiments. In the embodiment illustrated in FIG.

Figure 3:
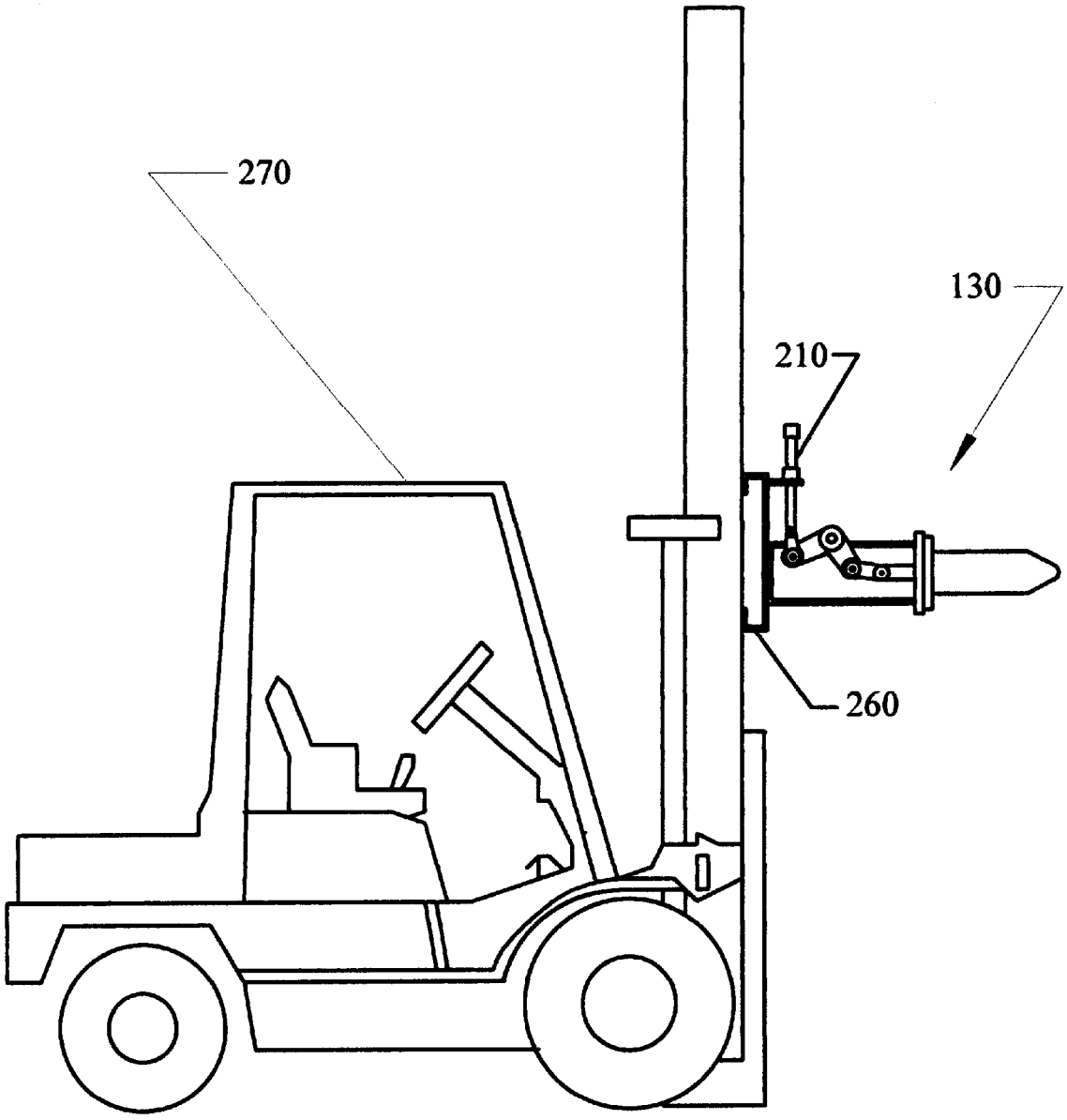
FIG. 3 illustrates a pipe gripper coupled with a forklift.

2, the actuator 210 is supported by a flange 211 of the forklift bracket 260. FIG. 3 shows the pipe gripper 130 attached to a forklift 270 through the forklift bracket 260. Most preferably, a standard side-shifting forklift is used. In particular, the pipe gripper 130 is intended to be coupled with the Model H60XM 3-ton forklift built by the Hyster Company. This forklift 270 can deliver hydraulic pressure to attachments, therefore the use of a hydraulic actuator 210 is preferred.

Figure 4:
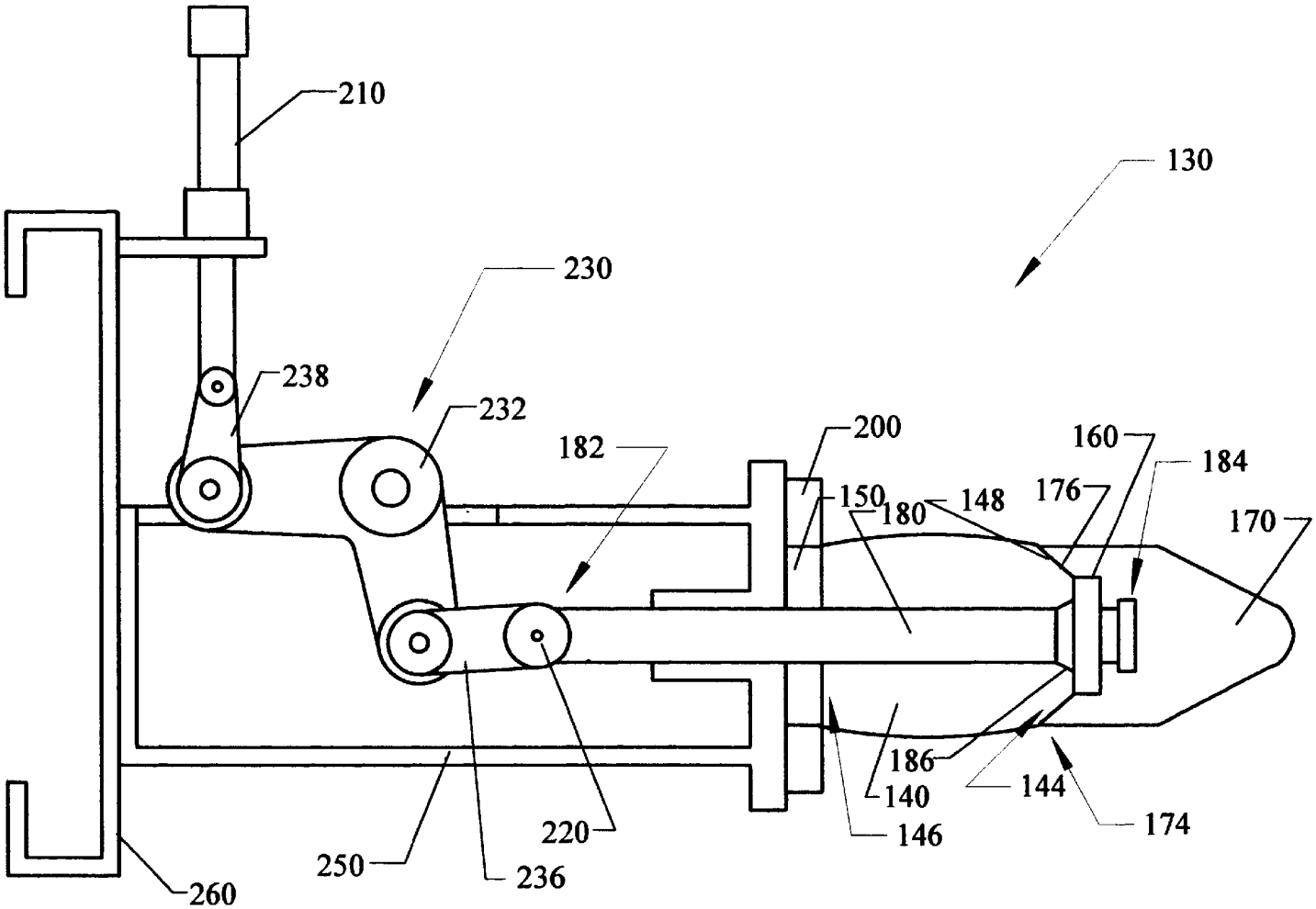
FIG. 4 displays a preferred embodiment of a pipe gripper after being activated.

The principles involved in the operation of the pipe gripper 130 are easily surmised through a comparison of the pipe gripper 130 in its undeployed and deployed states in FIGS. 2 and 4, respectively. In the undeployed state in FIG. 2, the expansion sleeve 140 has a substantially constant radius along its length (except for the external bevel 148 at its distal end 144). To deploy the pipe gripper 130, the actuator 210 draws the vertical link 238 upward, thereby rotating the bell crank 232 about its axis and pulling the horizontal link 236. This applies a tension to the mandrel 180, thereby pulling the nosepiece 170 and the distal pressure plate 160 toward the proximal pressure plate 150. This action compresses the expansion sleeve 140 axially, which results in a radial bulging of the expansion sleeve 140, as shown in FIG. 4. Reversing the process allows the expansion sleeve 140 to return to its original shape.

In the embodiment of FIGS. 2 and 4, both the nosepiece 170 and the distal pressure plate 160 exert compressive forces on the distal end 144 of the expansion sleeve 140. In some other embodiments, only the distal pressure plate 160 exerts a compressive force on the distal end 144 of the expansion sleeve 140, and in still other embodiments, only the nosepiece 170 exerts a compressive force on the distal end 144 of the expansion sleeve 140. In embodiments in which the base 174 of the nosepiece 170 is beveled, the angle of the bevel controls the bulging of the expansion sleeve 140. Large bevel angles tend to direct the bulging to the middle portion of the expansion sleeve 140 while small bevel angles (or no bevel) often lead to somewhat increased bulging at the proximal 146 and distal 144 ends of the expansion sleeve 140. When used to grip a pipe, the radial bulging of the expansion sleeve 140 forces the expansion sleeve 140 against an inner wall of the pipe. Large frictional forces between the expansion sleeve 140 and the pipe allow the pipe to be pushed or pulled by the pipe gripper 130.

Although the pipe gripper embodiments described above are preferred, the main feature of the pipe gripper is that it has an expansion sleeve that can be forced outward into engagement with an inner wall of a pipe.

Figure 5:
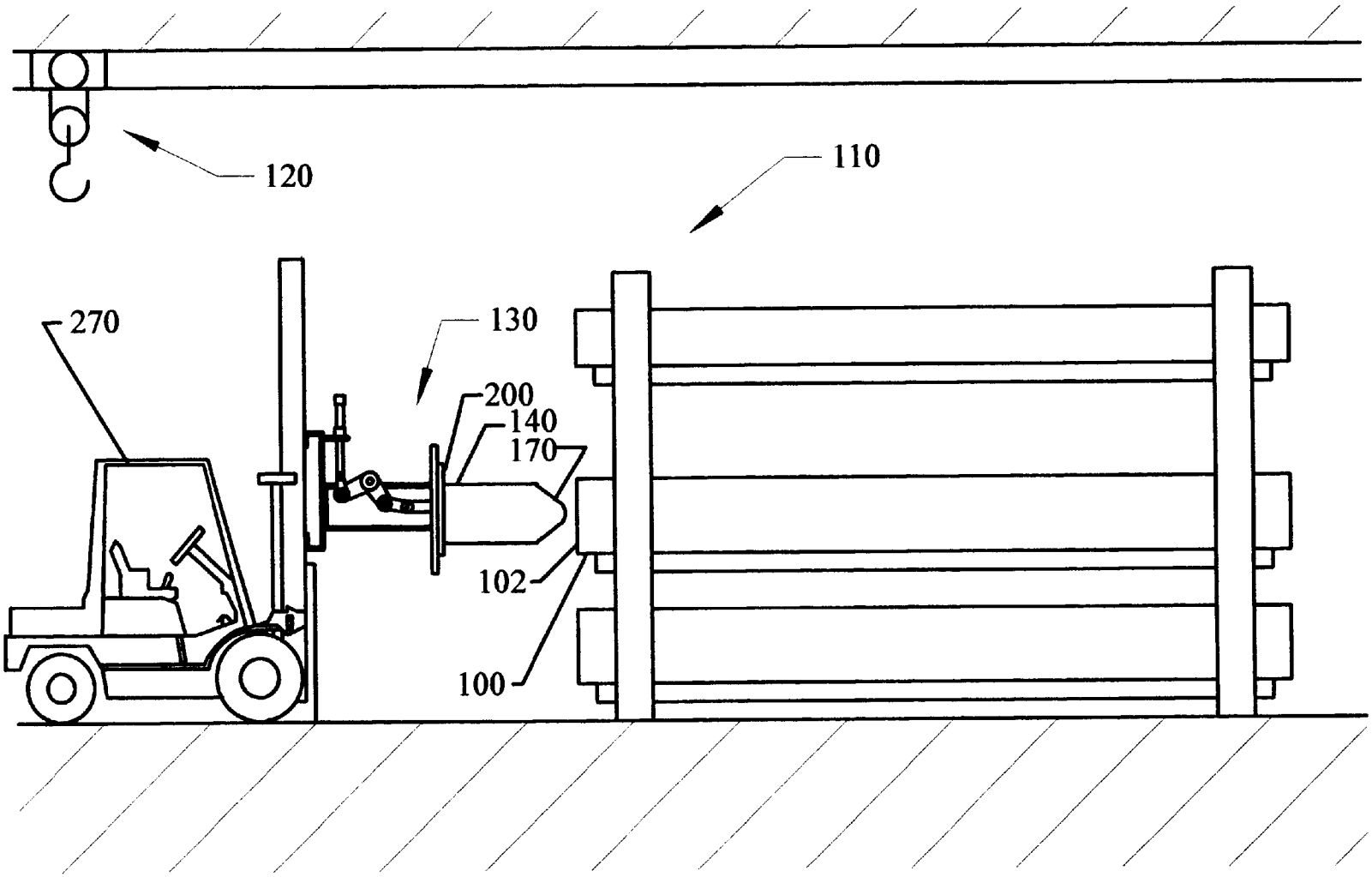
FIG. 5 shows a forklift in position to insert a pipe gripper into a pipe on a rack.
Figure 6:
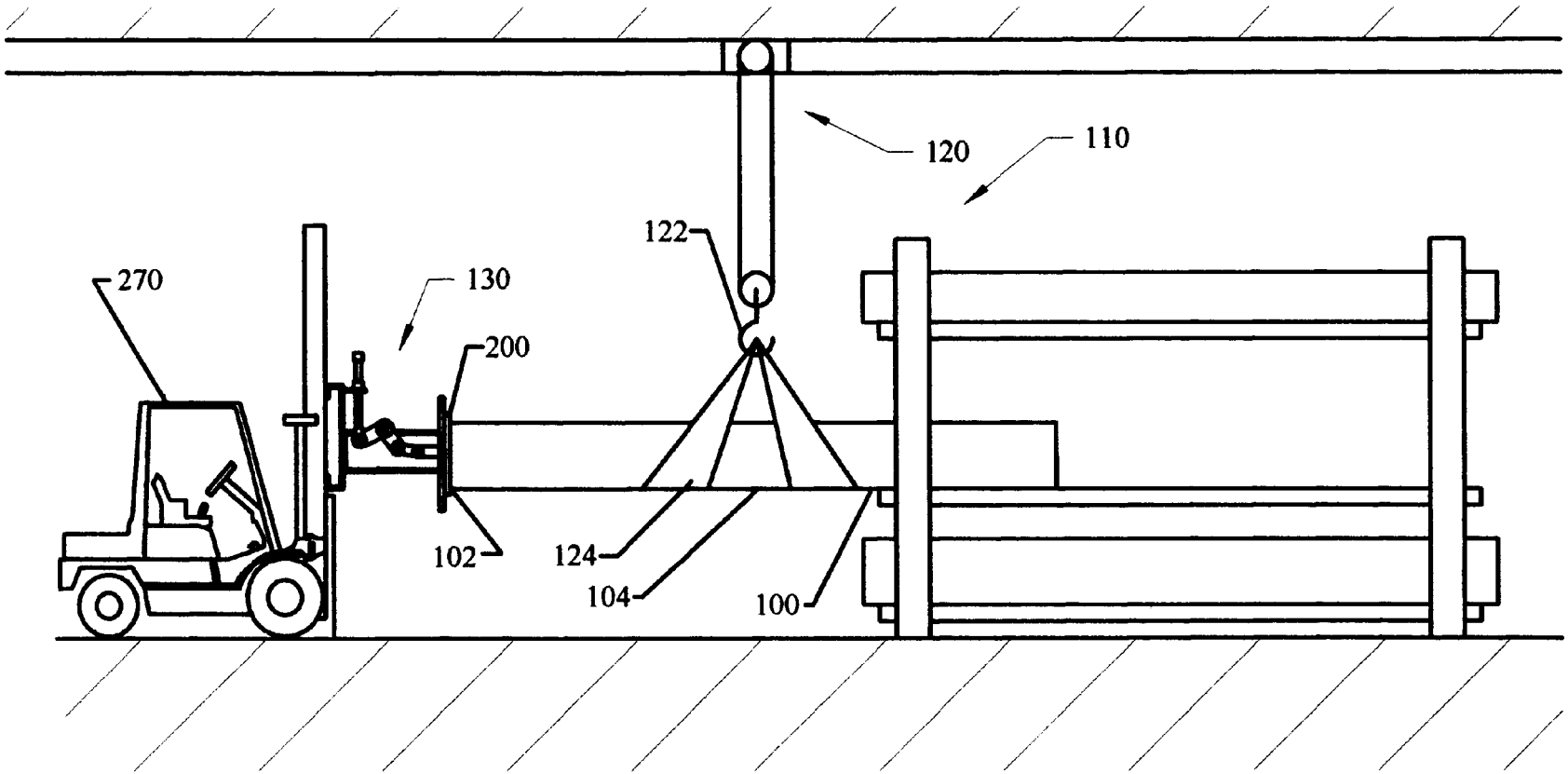
FIG. 6 displays a forklift and pipe gripper supporting an end of a pipe and a crane sling wrapped around the middle portion of the pipe.

FIGS. 5 and 6 show a preferred embodiment of a new pipe unracking method that employs the pipe gripper 130 described above. A pipe 100 is stored on a rack 110. A pipe gripper 130 is shown coupled to a forklift 270. In FIG. 5, the expansion sleeve 140 and the nosepiece 170 of the pipe gripper 130 are shown. Preferably a variety of differently sized expansion sleeves 140 can be installed on the pipe gripper 130. The expansion sleeve 140 chosen is sized to fit inside the pipe 100 with little clearance. With the appropriate expansion sleeve 140 installed, the operator uses the forklift 270 to insert the pipe gripper 130 into an accessible end 102 of the pipe 100. The inclined sides of the nosepiece 170 help to self-orient the pipe gripper 130 coaxially with the pipe 100. Interaction of the nosepiece 170 and the pipe 100 tend to push the nosepiece 170 and expansion sleeve 140 into alignment with the pipe 100. This allows the operator to easily make minor adjustments to the position of the pipe gripper 130 during initial insertion. When the position is correct, the operator moves the forklift 270 forward until the bumper pad 200 contacts the accessible end 102 of the pipe 100.

After the pipe gripper 130 is fully inserted in the pipe 100, the expansion sleeve 140 of the pipe gripper 130 is forced outward against an inner wall of the pipe 100. For example, compressive forces on the distal and proximal ends of the expansion sleeve 140 cause radial bulging, thereby forcing the expansion sleeve 140 against the inner wall of the pipe 100. The friction force between the expansion sleeve 140 and inner wall of the pipe 100 allows the pipe to be slid partially off the rack by reversing the direction of the forklift 270.

Referring to FIG. 6, when the center of gravity 104 of the pipe 100 is clear of the pipe rack 110, a crane sling 124 is attached to the pipe 100. In this embodiment, the crane sling 124 is supported by an overhead crane 120 via a crane hook 122. In other embodiments, a truck-mounted crane, or any device suitable for supporting the crane sling 124, is substituted for the overhead crane 120. Also not shown in the figure is an alternate embodiment wherein the accessible end 102 of the pipe 100 is raised slightly by the pipe gripper 130, thereby permitting the crane sling 124 to be manipulated into position with less of the pipe withdrawn from the rack 110. This mode of operation is useful under certain circumstances. Referring again to FIG. 6, with the weight of the pipe 100 supported primarily in the crane sling 124, the pipe 100 is manipulated off the rack 110. The pipe gripper 130 is removed from the pipe 100 after releasing the compressive forces that forced the expansion sleeve 140 to bulge outward. Depending upon the circumstances, the pipe gripper 130 is removed from the pipe 100 either before or after the pipe 100 is fully off the rack 110. However, the pipe gripper 130 is not removed until after the weight of the pipe 100 is substantially supported in the crane sling 124. After the pipe 100 is clear of the rack 110, the overhead crane 120, or an appropriate substitute transports it.

A method for racking pipe onto a pipe rack 110 is similar to the unracking process described above practiced in reverse. With reference to FIGS. 6 and 5, in the racking process, a pipe that is supported in a crane sling 124 is manipulated so as to place a first end of the pipe 100 on the rack 110. A pipe gripper 130 having an expansion sleeve 140 sized to fit in the pipe 100 is inserted into an accessible end 102 of the pipe 100. Preferably, insertion continues until the accessible end 102 of the pipe 100 contacts the bumper pad 200. After insertion, the pipe 100 is supported at the first end by the rack 110 and at the accessible end 102 by the pipe gripper 130. In this configuration, the support that is provided by the crane sling 124 is unnecessary and generally undesirable, so the crane-sling support is removed. Preferably, the crane-sling support is removed by lowering the height of the crane sling 124, thereby removing any pressure that the crane sling 124 might apply to the pipe 100. Alternatively, the crane-sling support is removed by completely removing the crane sling 124 from around the pipe 100. However, the preferred approach is more desirable because in it, the crane sling 124 can rapidly resupport the pipe 100 if an emergency situation develops. Either before or after removal of the crane-sling support, but after insertion of the pipe gripper 130, the pipe gripper 130 is activated, thereby forcing the expansion sleeve 140 against an inner wall of the pipe 100. With the expansion sleeve 140 pressed against the pipe inner wall, the pipe gripper 130 then moves so as to slide the pipe 100 fully onto the pipe rack 110. The pipe 100 is considered to be fully on the pipe rack 110 when the pipe gripper 130 can be removed from the pipe 100 without the pipe 100 falling from the rack 110. With the pipe 100 fully on the rack 110, the pipe gripper 130 is removed from the pipe 100. As with the unracking process, coupling a forklift 270 to the pipe gripper 130 greatly facilitates movement of the pipe gripper 130.

The above description and drawings are only illustrative of preferred embodiments which achieve the objects, features and advantages of the present invention, and it is not intended that the present invention be limited thereto. Any modification of the present invention that comes within the spirit and scope of the following claims is considered part of the present invention.

What is claimed is:

1. A pipe gripper, comprising:

an expansion sleeve having a distal end, a proximal end, and a bore the therethrough;

a proximal pressure plate abutting the proximal end of said expansion sleeve;

a nosepiece at the distal end of said expansion sleeve;

a mandrel passing through the bore of said expansion sleeve, said mandrel having a proximal end and a distal end, the distal end being attached to said nosepiece;

a distal pressure plate at the distal end of said expansion sleeve, said distal pressure plate being coupled to said mandrel such that pulling the proximal end of said mandrel axially compresses said expansion sleeve between said distal pressure plate and said proximal pressure plate;

wherein pulling the proximal end of said mandrel causes both said nosepiece and said distal pressure plate to exert compressive forces on the distal end of said expansion sleeve; and wherein the distal end of said expansion sleeve has an external bevel and said nosepiece has an internal bevel for receiving the external bevel of said expansion sleeve.

2. A pipe gripper, according to claim 1, further comprising:

a bumper pad coupled to said proximal pressure plate.

3. A pipe gripper, according to claim 2, further comprising:

an actuator;

a transmission; and a quick-change retainer pin;

said quick-change retainer pin coupling the proximal end of said mandrel to said transmission, said transmission transforming and transmitting motion from said actuator into axial motion of said mandrel.

4. A pipe gripper, according to claim 3, further comprising:

a housing coupled to said proximal pressure plate;

a forklift bracket secured to said housing; and a forklift, said forklift bracket being attached thereto.

5. A pipe gripper, according to claim 4, wherein said expansion sleeve has a Shore A durometer value ranging from about 70 to about 80.

* * * * *